US007353939B2

(12) United States Patent
Coe et al.

(10) Patent No.: US 7,353,939 B2
(45) Date of Patent: Apr. 8, 2008

(54) PILL CASES WITH A RETRACTABLE DISPLAY ASSEMBLY

(75) Inventors: Matthew T. Coe, Annandale, NJ (US); Fred Pether, St. Pertersburg, FL (US); Richard Costa, Bedminster, NJ (US); Hung Mach, Flushing, NY (US)

(73) Assignee: PharmaDesign Inc., Warren, NJ (US)

( * ) Notice: Subject to any disclaimer, the term of this patent is extended or adjusted under 35 U.S.C. 154(b) by 454 days.

(21) Appl. No.: 11/112,482

(22) Filed: Apr. 22, 2005

(65) Prior Publication Data

US 2007/0023316 A1 Feb. 1, 2007

(51) Int. Cl.
*B65D 69/00* (2006.01)

(52) U.S. Cl. ..... 206/232; 206/534; 206/538

(58) Field of Classification Search ..... 206/232, 206/1.5, 468, 528, 534, 538
See application file for complete search history.

(56) References Cited

U.S. PATENT DOCUMENTS

| | | | | |
|---|---|---|---|---|
| 2,975,889 | A * | 3/1961 | Brown | 206/468 |
| 3,367,491 | A * | 2/1968 | Dunham et al. | 206/468 |
| 4,254,868 | A * | 3/1981 | Humble et al. | 206/1.5 |
| 4,365,708 | A * | 12/1982 | Tyus | 206/232 |
| 4,936,462 | A * | 6/1990 | Yuen | 206/542 |
| 5,129,520 | A * | 7/1992 | Gaspar | 206/534 |

* cited by examiner

*Primary Examiner*—Luan K Bui
(74) *Attorney, Agent, or Firm*—Watov & Kipnes, P.C.

(57) ABSTRACT

A pill case includes a pill holding portion having at least one pill holding compartment for receiving and retaining a pill, and a retractable display assembly in operative association with the pill holding portion, wherein the retractable display assembly includes a retractable card having at least one surface defining a display area for displaying indicia which can be read by a user, the retractable card is being movable to a non-retracted position in which the retractable card is at least substantially uncovered with respect to the pill holding portion and an assembly for preventing the retractable card from disengaging from the retractable display assembly.

12 Claims, 8 Drawing Sheets

PILL CASES WITH A RETRACTABLE DISPLAY ASSEMBLY

FIELD OF THE INVENTION

The present invention is relates to a pill case, and more particularly a pill case having a retractable display or indicating assembly.

BACKGROUND OF THE INVENTION

Pill cases, also known as pill boxes, are compact containers for housing medications such as pills, tablets, or capsules. Such personal pill cases are known in the art, and are typically designed to be small and unobtrusive so that they can be carried by the user in a purse or in a shirt pocket or other convenient location. They allow users to pack limited individualized dosages of one or more medications, and thus enable convenient short-term carry.

Personal pill cases typically include multiple compartments, which are generally individually accessible by the user through a corresponding closure. Each compartment is adapted to receive and retain a single grouping or dose of one or more medications to be taken at a particular time, which may be individually identified by indicia printed on the closure or in proximity to the compartments. In this manner, the personal pill cases can be implemented to enable users to take their medication at the appointed times.

Since the number or amount of dosages held in such personal pill cases is normally limited, the user must periodically refill the case typically from the standard pill containers supplied by the pharmacist. Such small, pocket-sized pill cases, which have been used for years, allow the user to pre-fill the container with medication to be dispensed for that day, and to conveniently carry it with them. These personal pill cases have been found to enhance the ease and regularity of administration by reminding the user of the proper time for dispensing of pills in a more consistent manner. In addition, their small size and compact profile make them especially convenient for individuals needing to take medications at scheduled intervals.

In writing out prescriptions, physicians typically include instructions pertaining to the frequency of ingestion of prescribed medication in specific time intervals (e.g. once a day or after every meal). Such intervals may range from a matter of hours to days depending on the medication and the condition being treated. Prescription medications are typically filled for the patient with the necessary drug information supplied by the pharmacist. Many over-the-counter medications include packaging printed with necessary drug information such as administration instructions and dosing, symptoms and conditions to be treated, warnings, ingredients, and the like to inform patients of proper dispensing. The drug information accompanying such medications is important to ensure compliance on the part of the patient and that the patient is properly informed about the particulars of the corresponding drug regimen.

Some examples of pills that are prescribed in a set dose and periodic time regimen include those that are administered for birth control, for regulating blood pressure, for regulating blood lipids, as antibiotics, and for treating a variety of other ailments such as diabetes. Failure to properly follow the physician's instructions often results in ineffective treatment, possible injury or even death. Thus, it is important to ensure patient compliance with prescription medications and other medications as well.

Such drug information, however, may not be readily accessible for patients who choose to use personal pill cases to store and carry their pills. While traditional personal pill cases facilitate the use and transportation of medications, such cases have been found to be inadequate when the user is needs to access or carry information regarding the medication contained therein. In such an instance, the user often may not be able to retrieve the information in a timely manner, and thus, may inadvertently take the medications in an improper manner.

Accordingly, there is a need for pill cases, which are capable of accommodating one or more dosable ingestible products typically in the form of pill medications which may be administered at the same or different time intervals and/or groupings during the day, while maintaining ease of use and storage and carry convenience. There is a further need for providing pill cases that comprise a retractable display or indicating means to permit access to information useful to the patient including medication instructions or details such as dosage regimen. It would be a still further advantage in the art if the pill case is designed to be compact, capable of providing easy access to the pills contained therein, and convenient to carry and store in a purse, shirt pocket or the like, while at the same time promoting compliance and safety for patients by substantially reducing confusion, uncertainty or forgetfulness.

SUMMARY OF THE INVENTION

The present invention relates generally to a pill case having multiple compartments or slots designed to hold several groupings or doses of one or more pills as broadly defined herein which may or may not contain an active ingredient such as a medications, and the like, for convenient storage and when in the form of a personal pill container, easy to carry. Each of the multiple compartments is designed to form a single area for holding a single pill or grouping of pills. The multiple compartments may further include indicia to assist the user in identifying the pills contained therein and when in the form of a personal pill container, which dosages are to be administered at a particular scheduled time. The pill case of the present invention permits the user to visually determine whether a particular grouping or dose had been taken. The present invention provides the user with a simple tool to organize, store, and remember the proper schedule for administering medication, all within a personal pill container that is compact so that is may be readily carried in a pocket, purse or the like.

The pill case of the present invention further includes compliance features useful for facilitating proper medication dosing and usage over the period of time. In particular, the pill case includes a housing with a pill holding portion, and a retractable display or indicating assembly in operative engagement with the housing. The retractable display assembly includes a retractable tab or card slidably movable between a retracted position and an extended, non-retracted position with at least one surface defining a display area having indicia applied thereto, which may be viewed by the user in the non-retracted position. The pill holding portion includes a plurality of pill holding compartments or slots arranged in a discrete layout, and a cover or multiple individual covers for reversibly enclosing the compartments or slots.

The pill holding portion may be adapted to receive and accommodate any number of pills depending on the maximum capacity of the case for matching with a particular dosage regimen particularly suited for the patient. For example, if the patient requires a 7-day medication regimen or a 14-day regimen, then the pill holding portion of the pill case may be filled to accommodate the required number of pills. The pill case of the present invention can therefore accommodate short- and long-term prescriptions and is thus not limited to dosage regimens that are multiples of seven.

It will be understood that reference to the term "pill" as used herein shall include not only pills of a variety of shapes and sizes but all forms of dispensable solid products or articles of manufacture such as chewing gums, confectionery products (e.g., hard candies) which may include an active agent such as a medication, vitamin, nutraceutical and the like which can effectively be housed in the device of the present invention. Examples of "pills" as used herein include any solid ingestible product that can be carried in a pill case, including tablets, capsules, lozenges, caplets and the like. Likewise, all reference to a "pill case" shall mean a container which can accommodate the dispensable product or article of manufacture.

In one aspect of the present invention, there is provided a pill case comprising:

a pill holding portion having at least one pill holding compartment for receiving and retaining at least one pill therein; and a retractable display assembly in operative association with the pill holding portion, said retractable display assembly comprising a retractable card having at least one surface defining a display area for displaying indicia which can be read by a user, said retractable card being reversibly movable to a non-retracted position in which the retractable card is at least substantially uncovered with respect to the pill holding portion, and prevention means for preventing the retractable card from disengaging from the retractable display assembly.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
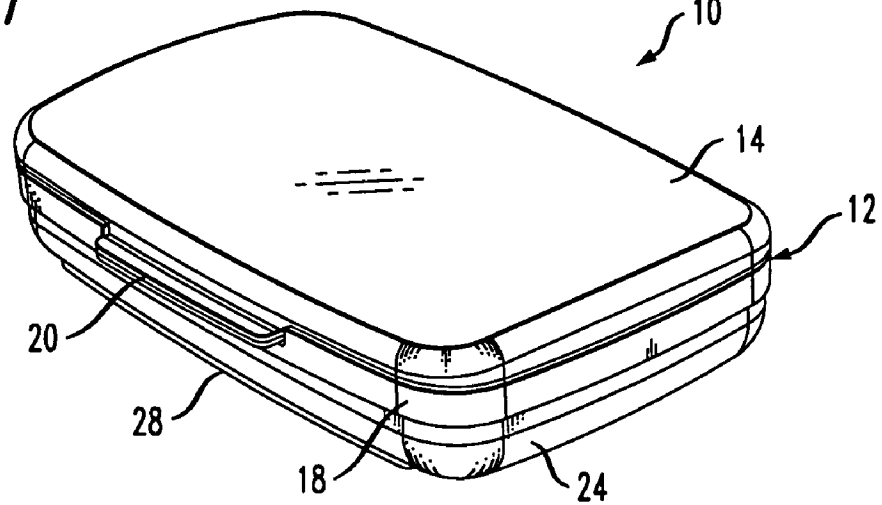
FIG. 1 is a top perspective view of a pill case for one embodiment of the present invention.
Figure 2:
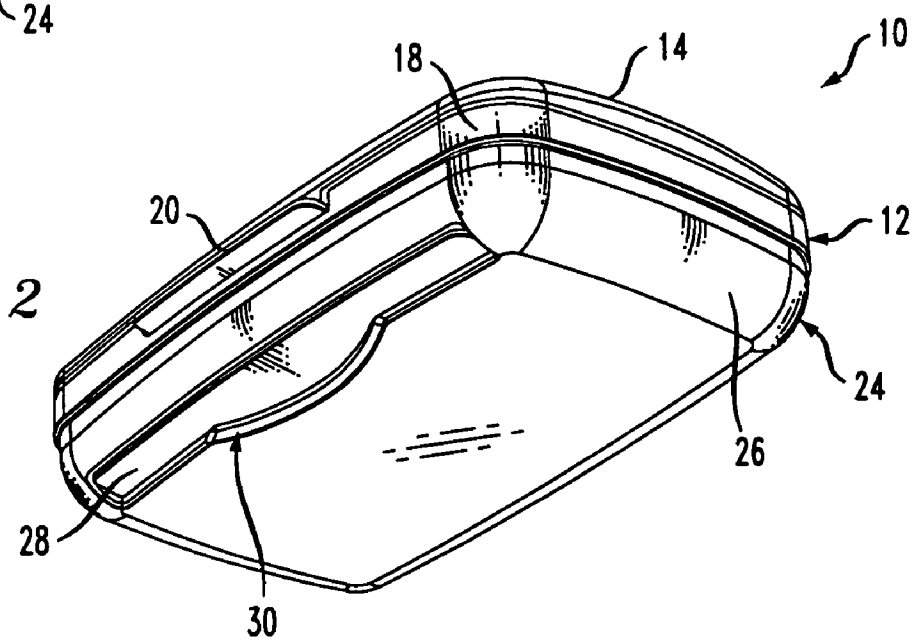
FIG. 2 is a bottom perspective view of the pill case of FIG. 1.
Figure 3:
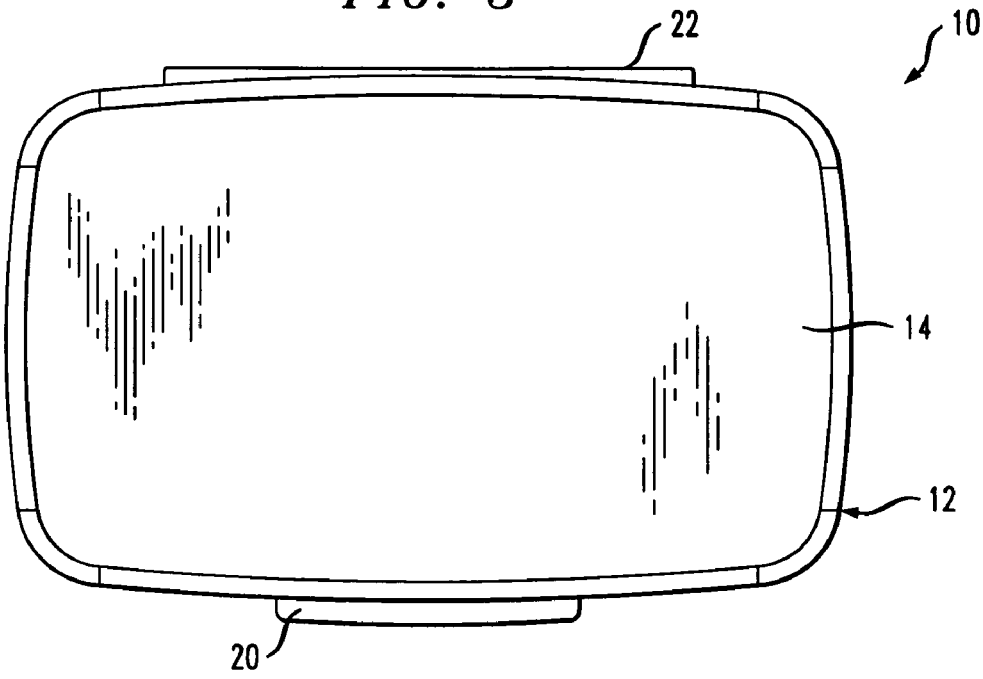
FIG. 3 is a top plan view of the pill case in accordance with the present invention.
Figure 4:
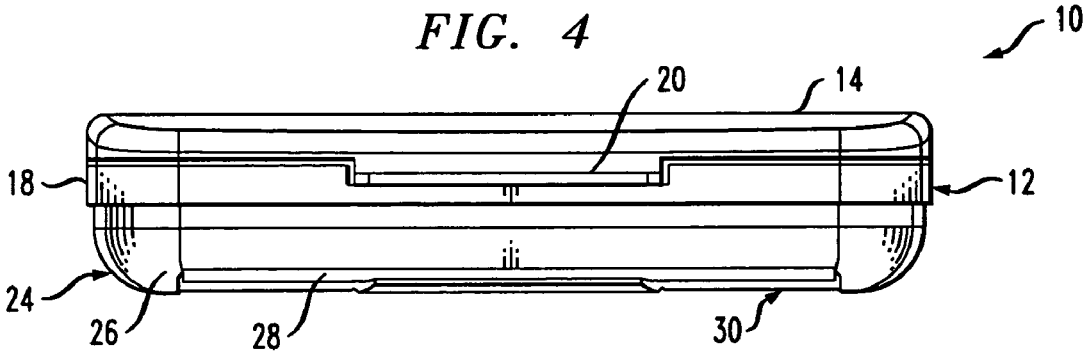
FIG. 4 is a front elevational view of the pill case in accordance with the present invention.
Figure 5:
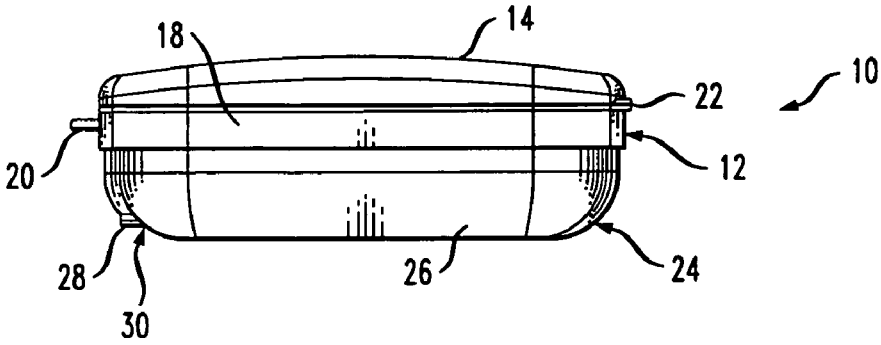
FIG. 5 is a side elevational view of the pill case which is similar to the opposing side in accordance with the present invention.

The present invention is directed to a pill case that includes compliance features which facilitate proper medication dosing over a regimen period. The pill case includes a housing having a pill holding portion composed of a plurality of pill holding compartments or slots arranged in a discrete layout, and a cover or multiple individual covers for reversibly enclosing the pill holding portion. The pill case further includes a retractable display assembly in operative engagement with the housing for supporting a retractable display area for easy access and viewing by the patient. The display indicia may contain indicia suitable for communicating any form of information to the patient including, but not limited to drug information, administration instructions and dosing, symptoms and conditions to be treated, warnings, ingredients, and the like, to inform patients of proper dispensing. In addition, the pill case of the present invention greatly enhances the privacy of the patient by enabling any personal drug information that the patient may prefer to keep undisclosed to be discretely hidden away from public view.

The indicia may communicate other forms of information or graphical communication depending on the application and/or product contained in the pill case of the present invention. In one form of the present invention, the retractable display area may be replaceable and/or interchangeable with other display areas as may be required by the purpose, application or product contained therein.

The pill case of the present invention is ergonomically designed to assist and enhance medication compliance for the patient and is sufficiently compact for easy carry and storage in one's pocket, purse or tight space. The pill case of the present invention includes features that enable the patient to properly follow a medication regimen, and is capable of accommodating any number of doses. This feature reduces the time and expense associated with packaging and dispensing pills.

It will be understood that the present invention can be used to store and dispense a variety of solid, edible articles including, but not limited to, gums, confections, vitamins, nutraceuticals and the like as previously described. For illustrative purposes, reference hereinafter will be to a pill case for dispensing pills, typically containing an active agent. Although rectangular pills slots and housing are shown, it is to be understood that the present pill case may be modified to encompass a range of shapes and sizes as required.

Referring to FIGS. 1 through 5, there is shown a pill case 10 in accordance with one embodiment of the present invention. Typically, a pharmacist or pharmaceutical supply vendor will load or fill the pill case 10 with medication prior to sale. However, the pill case 10 may be loaded or filled by the patient or end user from a standard pill container. The pill case 10 may be pre-packaged in a tamper resistant pouch to allow a pharmacist to apply an Rx label. The pill case 10 may be constructed of any durable material including plastic, and molded into any size, shape, or color for easy identification and association with a specific medication.

In the present embodiment as shown, the pill case 10 is adapted to accommodate up to 7 daily doses. It will be understood, however, that a greater or lesser number of daily doses may be accommodated by the present device in a modified form.

The pill case 10 includes a housing 12 including a pill holding portion 18 defining a plurality of pill holding compartment or slots 16 (see FIG. 6), and a cover 14 adapted for reversibly enclosing the slots 16. The cover may be in the form of multiple individual covers each enclosing one of the corresponding pill holding compartments. The pill case 10 is designed to accommodate and retain a plurality of pills in a discrete arrangement for secure storage and dispensing. The cover 14 includes a latch 20 operatively engaged to a latch slot 21 (shown best in FIG. 6) for reversibly securing the cover 14 to the pill holding portion 18, and a living hinge 22 (shown best in FIGS. 3, 5 and 6) for allowing the cover 14 to move pivotably between the closed and open positions during access and re-securement.

The pill case further includes a retractable display assembly 24 which is preferably positioned beneath the pill holding portion and is operatively associated with the housing 12 as will be described hereinafter. The retractable display assembly 24 comprises a carriage 26 including a card receiving cavity 38 (see FIG. 7) accommodating a retractable indicating card 28, and an opening 30 in the carriage 26 through which the card 28 can be accessed from the cavity 38 as will be described hereinafter. The retractable display assembly 24 include a card retaining mechanism 43 (see FIG. 9B), which operates to securely maintain the card 28 in operative engagement to the carriage 26 and prevent its entire removal from the carriage 26 as will be described hereinafter in connection with FIGS. 8A, 8B, 10 and 11.

Figure 6:
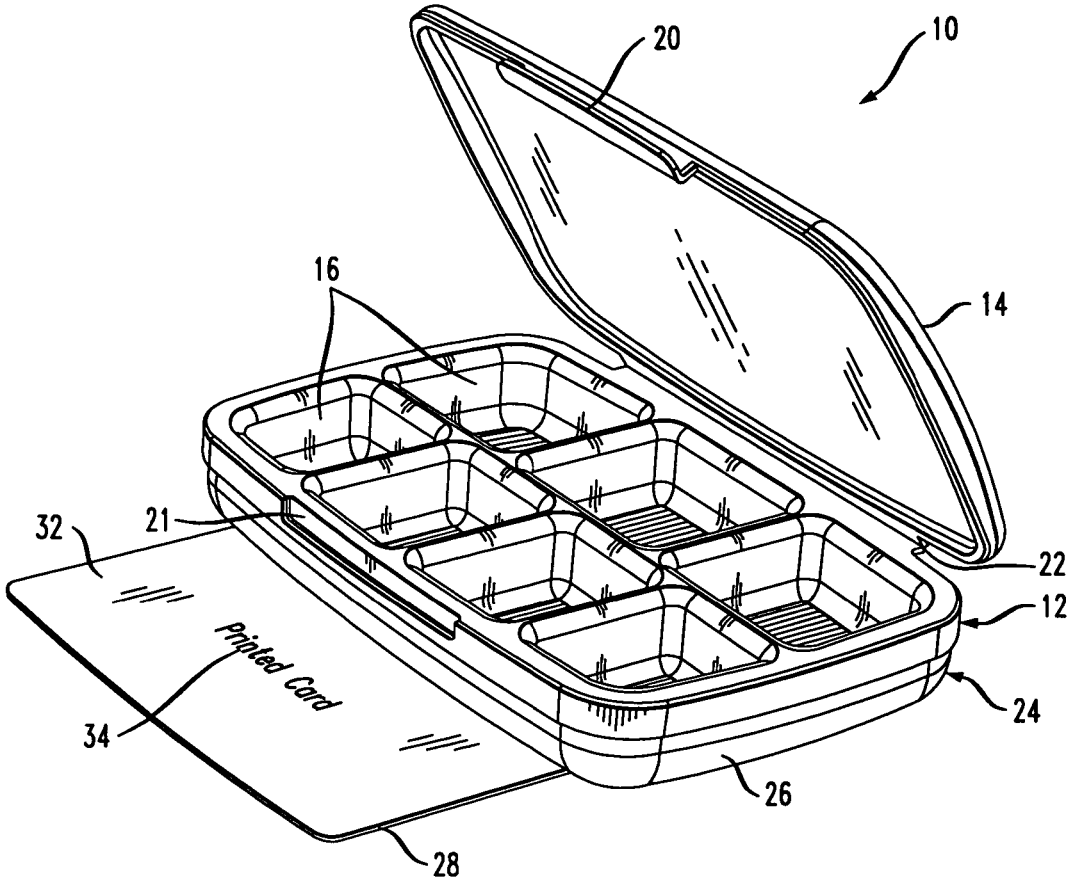
FIG. 6 is a perspective view of the pill case with an open cover and a retractable display or indicating assembly in an extended, non-retracted position in accordance with the present invention.

Referring to FIG. 6, the card 28 is movably slidable from the carriage 26 through the opening 30 between the retracted position in which the card is essentially fully contained within the cavity and thereby covered by the pill holding portion 18 out of the cavity 38 to a non-retracted position in which the retractable card is substantially moved out of the cavity so that it is not covered by the pill holding portion 18 thereby enabling the user to read the indicia printed on the retractable card. The retractable display assembly 24 may be adapted to retain the card 28 in operative engagement to the carriage 26, while facilitating free movement of the card 28 between the retracted and non-retracted positions through the opening 30. The card 28 further includes at least one surface 32 upon which indicia 34 such as alphanumeric characters, computer readable codes including barcodes, and the like, may be displayed to the patient and/or a scanner. The indicia 34 may communicate to the patient any information including, but not limited to drug information, administration instructions and dosing, symptoms and conditions to be treated, warnings, active ingredients, and the like.

Alternatively, the surface 32 may provide a base on which an adhesive label containing specific information such as Rx information can be applied thereon for future reference as well as provide privacy when the card 28 is retracted and hidden from public view.

The card 28 may be composed of any suitable material capable of receiving or supporting indicia in printed, embossed, etched or engraved forms on the surface thereof, including, but not limited to paper, cardboard, plastic, foil, laminated composites, and the like.

The pill holding compartments 16 each can accommodate one or more pills for carry and storage. The cover 14 can be urged to an open position by disengaging the latch 20 from the latch slot 21 and lifting the cover 14. The patient can pull the card 28 out through the opening 30 to view or read the indicia 34. The card 28 may be imprinted with the indicia 34 on one side or both sides thereof as needed. Alternatively, the surface 32 of the card 28 may also be adapted to receive handwritten information (e.g., writing notes, checking off dates, making personal reminders, and the like).

Figure 7:
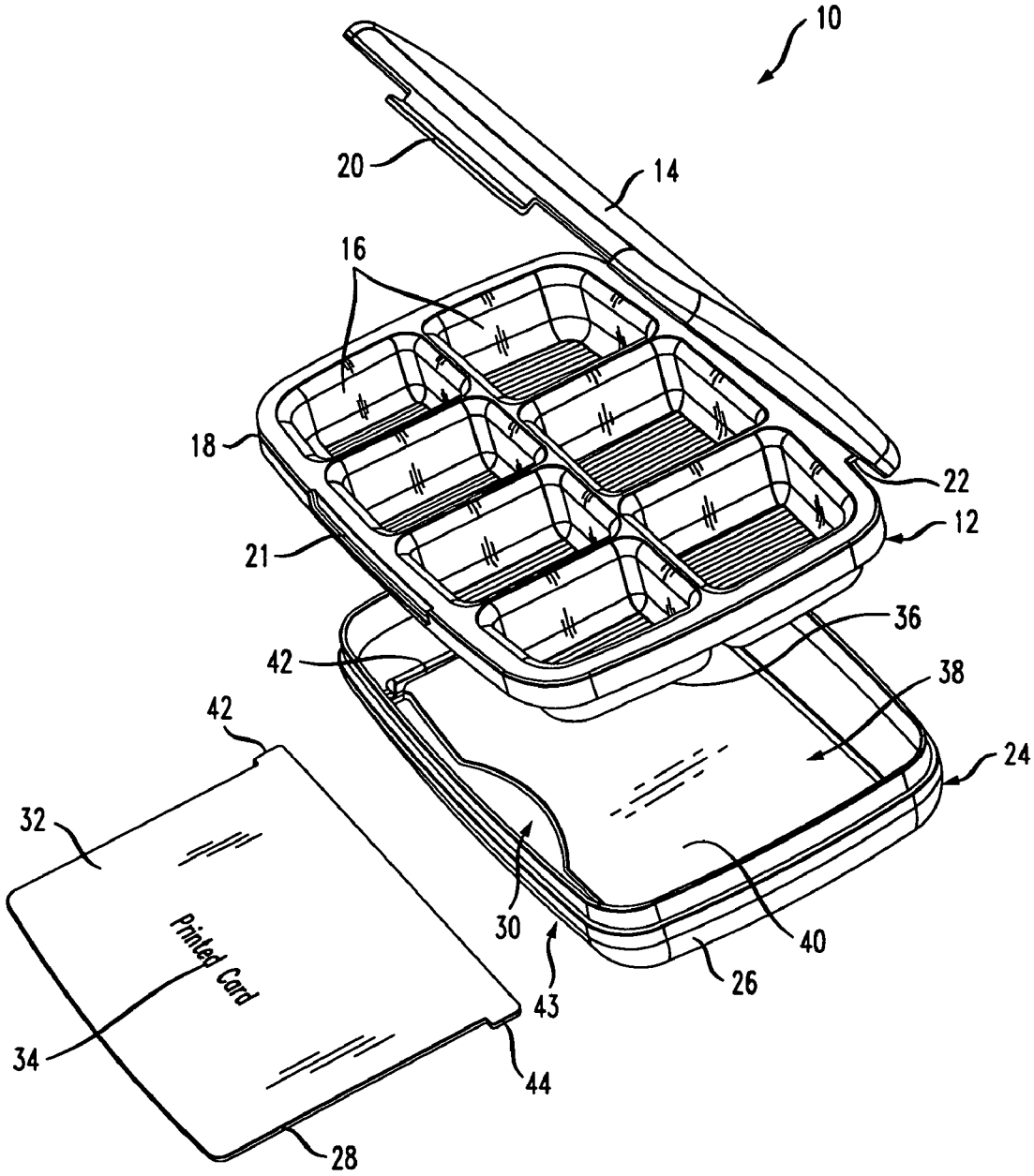
FIG. 7 is an exploded assembly view of the pill case in accordance with the present invention.

Referring to FIG. 7, the housing 12 of the pill case 10 is adapted for secure attachment to the carriage 26 of the retractable display assembly 24 to form a single unitary device. The housing 12 may be removably attached to the carriage 26 to permit replacement of the card 28 as needed. Alternatively, the housing and carriage may be fabricated as a single component. Thus, in one embodiment, the housing 12 may be mounted permanently to the carriage 26. The housing 12 and the carriage 26 may be composed of any suitable rigid container material including, and not limited to, plastic molded or extruded, metal, and the like.

As shown in FIG. 7, the housing 12 includes a lower base portion 36 that is dimensioned to fit into the cavity 38 of the carriage 26. The carriage 26 further includes a support area 40 on which the card 28 is carried, and a pair of grooved guides 42 each located along the corresponding side periphery of the support area 40. The opening 30 is configured to expose a portion of the card 28 in the retracted position for the patient to grasp, thus allowing the patient is to pull the card 28 out from the carriage 26 with ease.

The card retaining mechanism 43 of the pill case 10 prevents the card 28 from accidentally leaving the carriage 26. The card retaining mechanism 43 further comprises in the embodiment specifically shown in FIG. 7, a pair of detents 44 located on the corners of the interior end of the card 28, and a pair of stops 46 located at the interior side portions of the grooved guides 42 proximate the opening 30 as will be further described hereinafter. The card 28 is generally located between the lower base end 36 of the housing 12 and the support area 40 of the carriage 26. The support area 40 of the carriage 26 acts as a bearing surface and allows the card 28 to slide over the support area 40 of carriage 26.

During implementation, the pill case 10 can be used by a pharmacist to dispense medication to the patient, and includes a card 28 containing drug information associated with the dispensed medication. The patient may subsequently return the pill case 10 to the pharmacist for refilling the same or different medication. If a different medication is dispensed, the pharmacist may replace the old card 28 by disengaging the carriage 26 from the housing 12 and removing the old card 28 from the support area 40. The new card 28 containing the corresponding information is then placed in the support area 40 prior to re-engaging the carriage 40 to the housing 12.

Figure 8B:
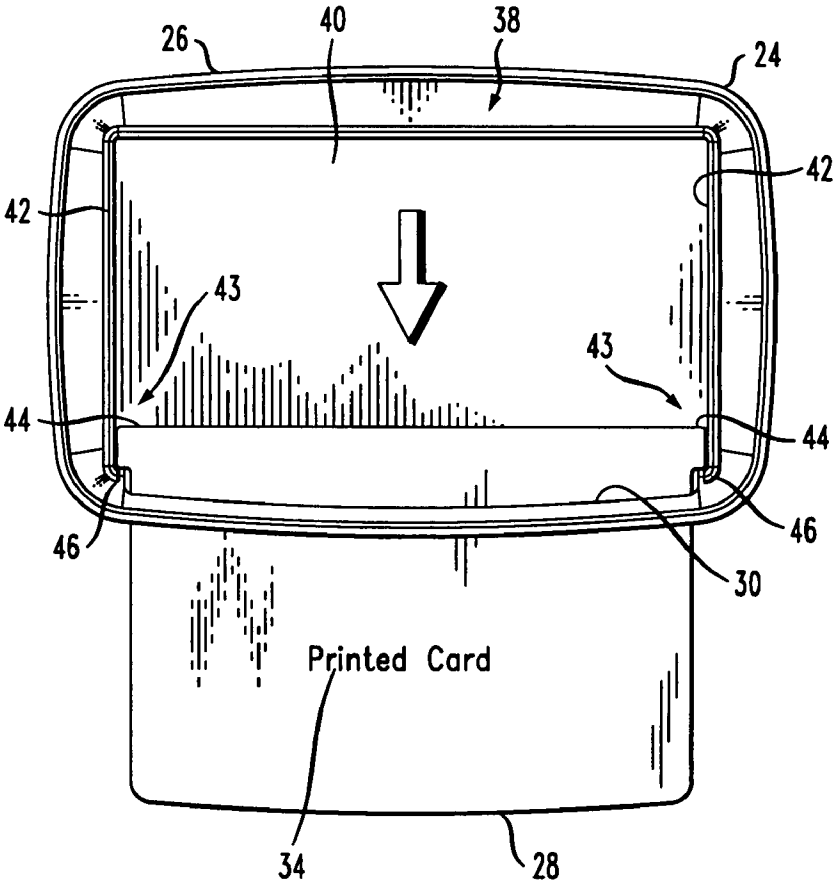
FIGS. 8A and 8B are each a top plan view of a retractable display or indicating assembly having a retractable tab in a retracted position and in an extended, non-retracted position, respectively, in accordance with the present invention.
Figure 8A:
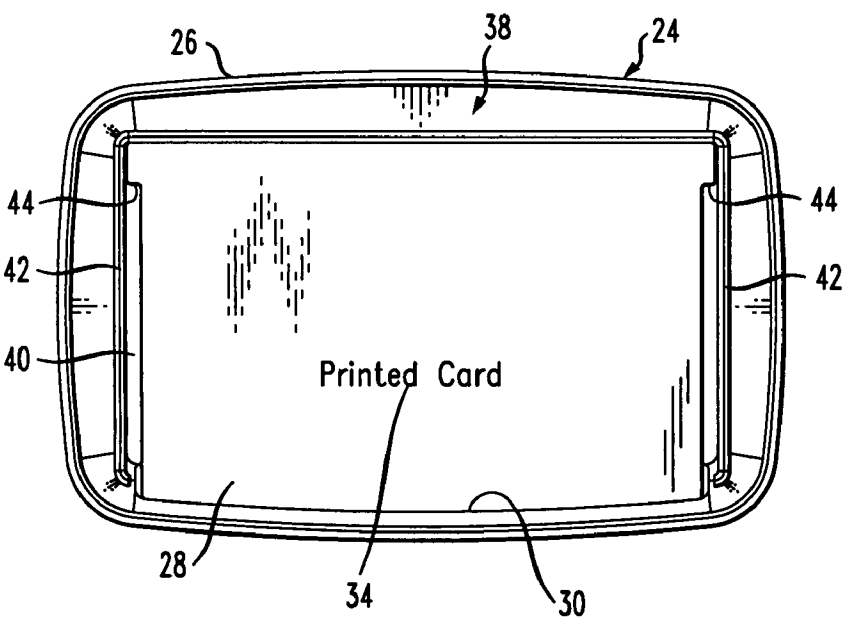

Referring to FIG. 8A, the retractable display assembly 24 is shown with the card 28 in the retracted position. The grooved guides 42 of the carriage 26 cooperate with the corresponding detents 44 of the card 28 to facilitate sliding movement of the card 28 within the carriage 26.

Referring to FIG. 8B, the retractable display assembly 24 is shown with the card 28 in the fully extended position. The card retaining mechanism 43 is formed in combination by the detents 44 of the card 28 and the stops 46 proximate the opening 30. When the card 28 is in the extended position, the card retaining mechanism 43 limits movement of the card 28, and prevent its removal from the carriage 26. The detents 44 of the card 28 abut against the stops 46, thus preventing further movement.

Figure 9:
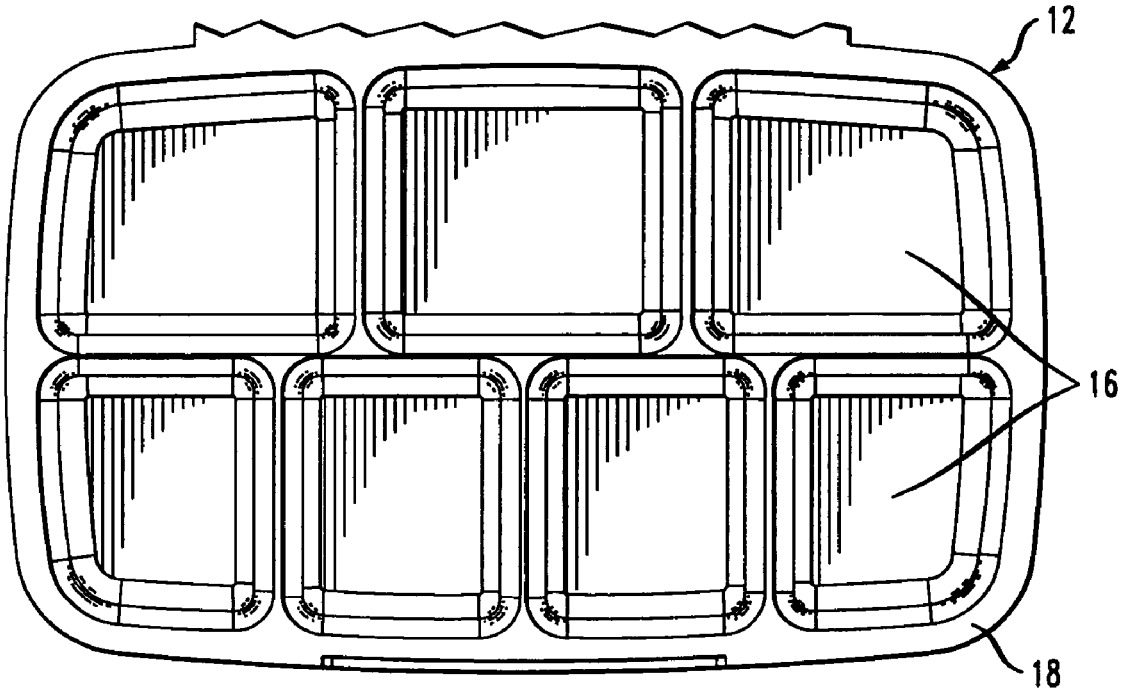
FIG. 9 is a top plan view of the multiple pill holding compartments or slots of the pill case in accordance with the present invention.

FIG. 9 is a top plan view of the pill holding portion 18 of the housing 12. The pill holding compartments 16 are suitably dimensioned to accommodate one or more pills in a spaced apart arrangement. As previously mentioned, the number, grouping and size of the compartments 16 may be modified according to the needs of the patient.

Figure 10:
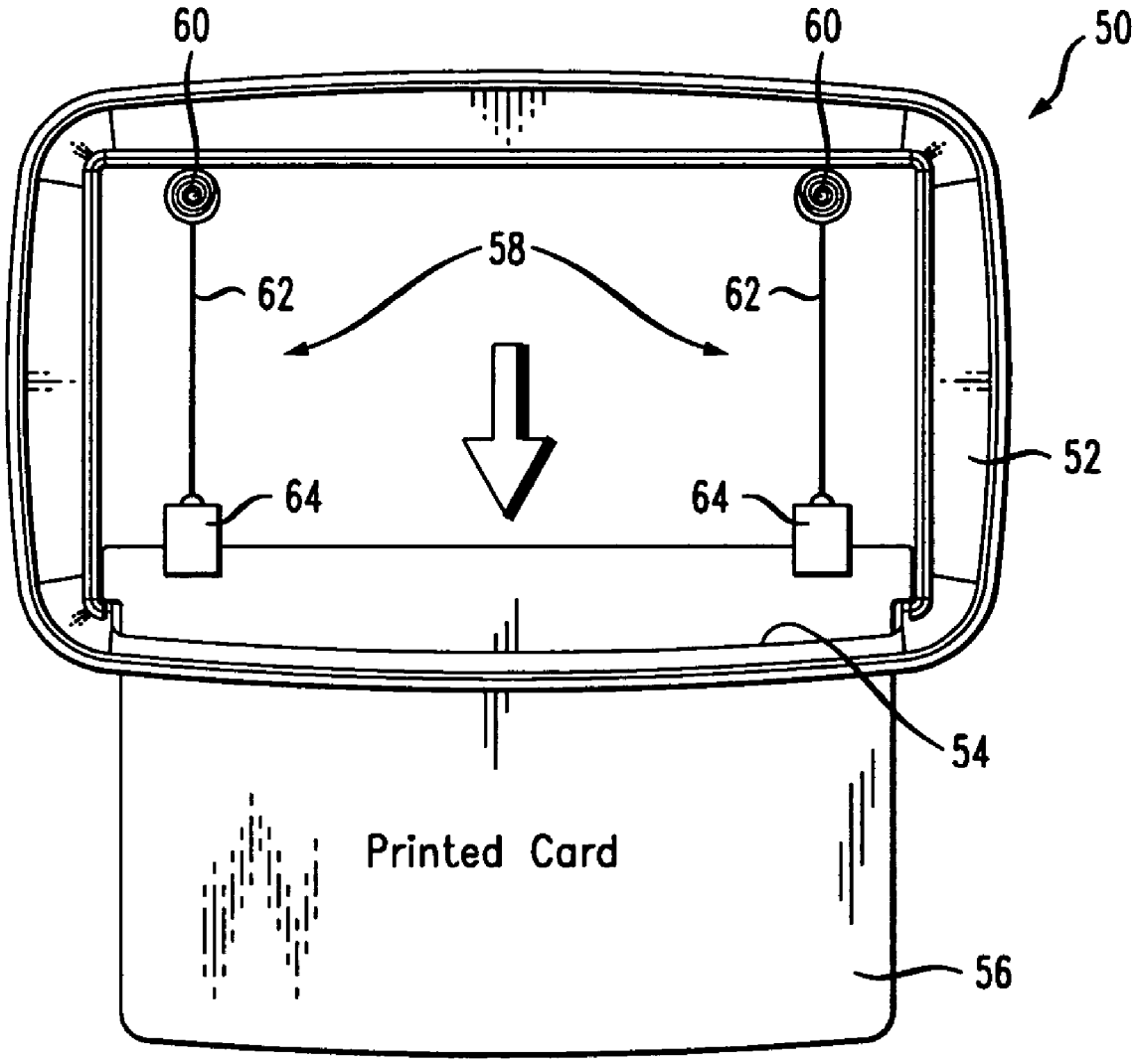
FIG. 10 is a top plan view of a retractable display or indicating assembly for an alternative embodiment of the present invention.

Referring to FIG. 10, a retractable display assembly 50 is shown for an alternative embodiment of the present invention. The retractable display assembly includes a carriage 52 with an opening 54, a retractable card 56, and a retractable card retaining mechanism 58. In this embodiment, the card retaining mechanism 58 comprises at least one, preferably a pair of spring biased spools 60 attached to carriage 52, a pair of cables 62 each extending from a spool 60, and a pair of cable fasteners 64 attached to the card 56. The cable fasteners 62 secure the card 56 to the cables 62, respectively.

The cables 62 are operatively engaged to a corresponding spool 60, and the spools 60 are spring biased to draw the card 56 through the opening 54 into the carriage 52. During usage, the patient can pull the card 56 out through the opening 54 in the same manner as previously described. Upon release, the card 56 is automatical drawn back into the carriage 52 by the action of the spring biased spools 60, which also operated to prevent the card 56 from being removed.

Figure 11:
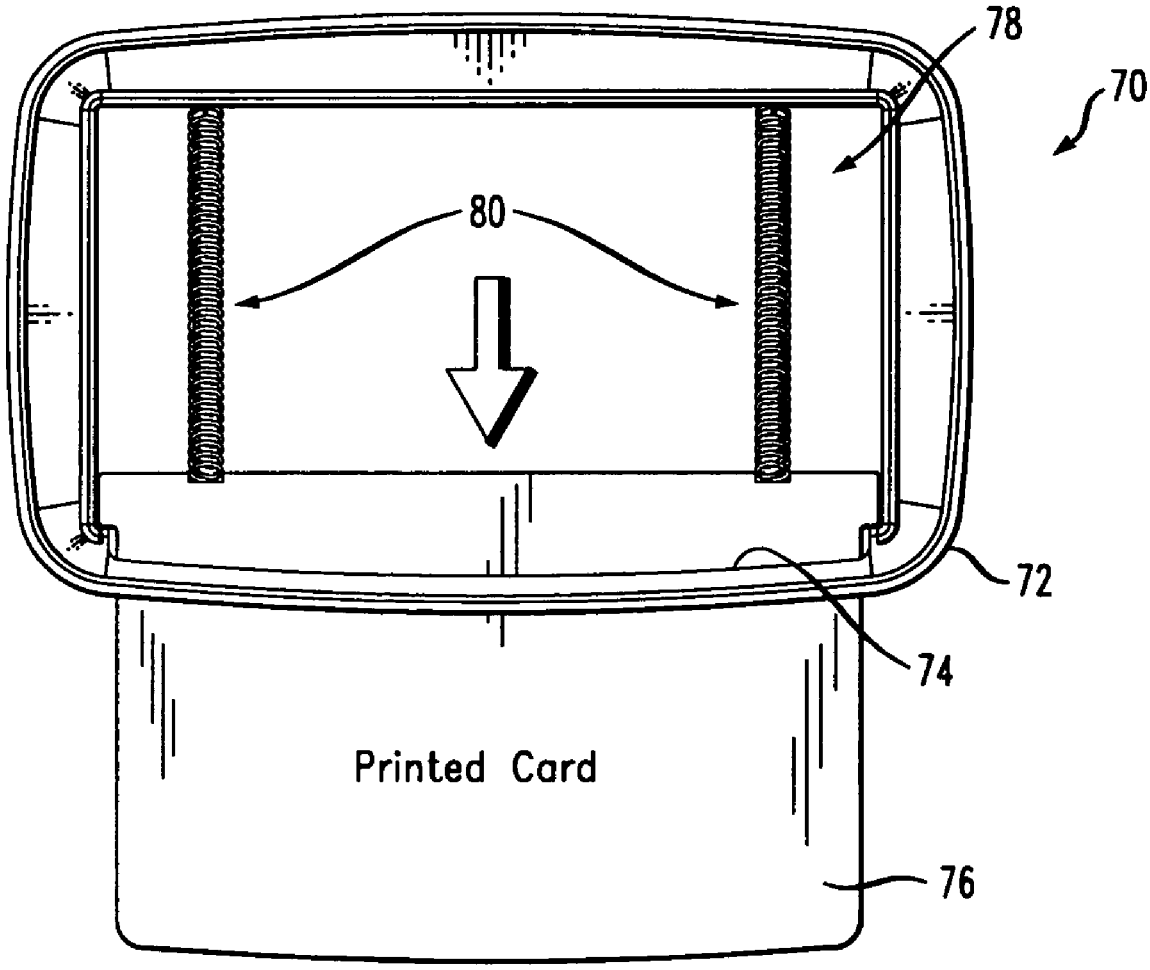
FIG. 11 is a top plan view of a retractable display or indicating assembly for a third embodiment of the present invention.

Referring to FIG. 11, a retractable display assembly 70 is shown for a third embodiment of the present invention. The retractable display assembly includes a carriage 72 with an opening 74, a retractable card 76, and a retractable card retaining mechanism 78. In this embodiment, the card retaining mechanism 78 comprises at least one, preferably a pair of springs 80 securely attached between the carriage 72 and the card 76. The springs 80 are operatively engaged to the card 56 to limit its movement through the opening 74, and prevent its removal from the carriage 72. During usage, the patient can pull the card 76 out through the opening 74 in the same manner as previously described. Upon release, the card 76 is automatically drawn back into the carriage 52 by the action of the springs 80.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A pill case comprising:

a pill holding portion removably attached to a retractable display assembly comprising:

at least one pill holding compartment for receiving and retaining at least one pill therein; and a cover hingedly attached to the pill holding portion, said cover being adapted to move from a closed position to an open position to provide access to the pill holding portion; and said retractable display assembly in operative association with the pill holding portion and positioned beneath the pill holding portion, said retractable display assembly comprising:

a retractable card having at least one surface defining a display area for displaying indicia which can be read by a user, said retractable card being reversibly movable to a non-retracted position in which the retractable card is at least substantially uncovered with respect to the pill holding portion; and prevention means for preventing the retractable card from disengaging from the retractable display assembly.

2. The pill case of claim 1 wherein the retractable display assembly comprises a retractable card retaining mechanism for automatically moving the retractable card from the non-retracted position to a retracted position in which the retractable card is at least substantially covered by the pill holding portion.

3. The pill case of claim 1 wherein the retractable display assembly comprises a retractable card retaining mechanism for manually moving the retractable card from the non-retracted position to a retracted position in which the retractable card is at least substantially covered by the pill holding portion.

4. The pill case of claim 1 wherein said prevention means comprises at least one detent on a side of the retractable card and a corresponding stop member positioned in the retractable display assembly wherein when the user moves the retractable card to the non-retracted position, the detent of the retractable card engages the stop member to prevent further movement of the retractable card.

5. The pill case of claim 1 wherein the retractable display assembly comprises a carriage comprising a retractable card receiving cavity for storing the retractable card when in the retracted position.

6. The pill case of claim 5 wherein the carriage contains a support area for supporting the retractable card within the cavity and for facilitating movement of the retractable card into and out of the cavity.

7. The pill case of claim 6 wherein the support area comprises a pair of spaced apart retractable card receiving grooves adapted to receive and retain respective opposed side portions of the retractable card therein wherein the retractable card is slidable within said grooves as the retractable card is moved between the retracted and non-retracted positions.

8. The pill case of claim 7 wherein the opposed side portions of the retractable cards are in the form of opposed detents.

9. The pill case of claim 8 wherein said prevention means comprises a stop member positioned in the retractable display assembly wherein when the user moves the retractable card to the non-retracted position, the detent engages the stop member to prevent further movement of the retractable card.

10. The pill case of claim 2 wherein the retractable card retaining mechanism comprises at least one spring biased spool assembly operatively engaged to the retractable display assembly and the retractable card wherein when the user releases the retractable card, the retractable card is moved via the spring biased spool assembly to the non-retracted position.

11. The pill case of claim 2 wherein the retractable card retaining mechanism comprises at least one spring operatively engaged to the retractable display assembly and the retractable card wherein when the user releases the retractable card, the retractable card is moved via the at least one spring to the non-retracted position.

12. The pill case of claim 1 wherein the pill holding portion and the retractable display assembly form a unitary pill case device.

* * * * *